US007083558B2

(12) United States Patent
Williams, Sr.

(10) Patent No.: US 7,083,558 B2
(45) Date of Patent: Aug. 1, 2006

(54) COMBINATION ABDOMINAL/PECTORAL EXERCISE DEVICE

(76) Inventor: Timothy Williams, Sr., 2715 Autumn Chase Dr., Chattanooga, TN (US) 37421

( * ) Notice: Subject to any disclaimer, the term of this patent is extended or adjusted under 35 U.S.C. 154(b) by 4 days.

(21) Appl. No.: 10/822,473

(22) Filed: Apr. 12, 2004

(65) Prior Publication Data

US 2005/0009678 A1 Jan. 13, 2005

Related U.S. Application Data

(60) Provisional application No. 60/463,614, filed on Apr. 17, 2003.

(51) Int. Cl.
*A63B 26/00* (2006.01)

(52) U.S. Cl. ..... 482/142; 482/62; D21/686

(58) Field of Classification Search ..... 482/140–142, 482/148; D21/686–690, 662, 191, 665; 297/175, 297/316, 326, 281; D6/349
See application file for complete search history.

(56) References Cited

U.S. PATENT DOCUMENTS

| | | | | | |
|---|---|---|---|---|---|
| D216,721 | S | * | 3/1970 | Sassenberg | D21/671 |
| 3,787,048 | A | * | 1/1974 | Bock | 482/145 |
| 4,494,533 | A | * | 1/1985 | Sgroi et al. | 606/241 |
| D280,922 | S | * | 10/1985 | Sieder | D21/690 |
| 4,638,995 | A | * | 1/1987 | Wilson | 482/142 |
| 4,890,606 | A | * | 1/1990 | Iams et al. | 602/32 |
| D320,245 | S | * | 9/1991 | Fitzpatrick | D21/676 |
| 5,044,632 | A | * | 9/1991 | Jones | 482/138 |
| D324,708 | S | * | 3/1992 | Walsh | D21/691 |
| 5,350,346 | A | * | 9/1994 | Martinez | 482/142 |
| 5,669,860 | A | * | 9/1997 | Reyes | 482/97 |
| D409,694 | S | * | 5/1999 | Kuo et al. | D21/675 |
| 5,911,535 | A | | 6/1999 | Gvoich | |
| 6,090,024 | A | * | 7/2000 | Tsou | 482/142 |
| 6,248,047 | B1 | * | 6/2001 | Abdo | 482/130 |
| 6,435,611 | B1 | * | 8/2002 | Walter | 297/316 |
| 6,443,879 | B1 | * | 9/2002 | Chen | 482/144 |
| 6,478,721 | B1 | | 11/2002 | Hunter | |
| D480,772 | S | * | 10/2003 | Washington | D21/686 |
| 6,712,742 | B1 | | 3/2004 | Suiter | |
| D488,522 | S | * | 4/2004 | Powers | D21/676 |
| D490,866 | S | * | 6/2004 | Powers | D21/676 |
| 2002/0137604 | A1 | * | 9/2002 | Chen | 482/95 |
| 2003/0078143 | A1 | * | 4/2003 | Breibart et al. | 482/130 |
| 2003/0078144 | A1 | * | 4/2003 | Gehrke | 482/140 |
| 2004/0142800 | A1 | * | 7/2004 | Gerschefske | 482/142 |

* cited by examiner

*Primary Examiner*—Lori Amerson
(74) *Attorney, Agent, or Firm*—Elizabeth Waiguchu, Esq.

(57) ABSTRACT

A multipurpose exercise device where a user sitting on the exercise device seat can exercise their muscles by first sitting in an upright position on the horizontally disposed seat, with the lower part of their feet pressing against the first horizontally disposed bar above their ankles. The user then leans back from their waist at approximately 45 degrees to the horizontally disposed seat then the user returns to an upright position. This exercise repeated several times affects the abdominal muscles. A user may also exercise the pectoral muscles with the exercise device when the user begins with both arms grasping the second horizontally disposed bar. A user then extends both arms and lowers the torso by bending the arms at the elbow to a convenient position parallel to the second horizontally disposed bar The user raises the torso to the beginning or original position by extending the arms again. The repetitive exercise against resistance provided by the user's body weight strengthens the pectoral muscle.

8 Claims, 5 Drawing Sheets

COMBINATION ABDOMINAL/PECTORAL EXERCISE DEVICE

I claim priority to Provisional Application No. 60/463,614 filed Apr. 17, 2003.

TECHNICAL FIELD

The present invention relates generally to an exercise device and more particularly to an apparatus for exercise of the human abdomen muscles and pectoral muscles.

BACKGROUND OF THE INVENTION

The present invention pertains to an exercise device for exercising pectoral and abdominal muscles. Presently, various types of exercise machines are available for different portions of the human anatomy such as the hip, thigh, buttocks and abdominal muscles. For example, U.S. Pat. No. 5,911,535 issued to Gvoich discloses a multipurpose thigh/hip/abdominal exerciser comprising a pair of side members each having a concave surface adapted to engage one of thighs of a user. Each of the side members are supported by a corresponding frame and attached to a resilient member that urges the side member toward the open side of the concave surface. The frames can be affixed in several orientations. While perhaps effective in providing exercise for a human abdomen, hip and thigh, this exercise apparatus is complex for users who have to be familiar with various orientations of the frames.

People who exercise desire equipment that does not require large space, is easy to move to a different location, can be used to exercise various muscles, is easy to use, and is not expensive because of the complexities of manufacture.

Accordingly, the present invention takes into account the aforementioned desired features associated with exercise machines.

It is the object of the present invention to provide an exercise apparatus for toning and/or building abdomen and pectoral muscles and yet not complex to manufacture.

It is the object of the present invention to effectively and conveniently provide abdominal and pectoral muscles exercises for the human anatomy in the same equipment.

It is also the object of the present invention to provide an abdomen and pectoral muscles exercise device that is simple for a user to operate.

It is a further object to provide an abdominal and pectoral muscles exercise device that is easily movable from one location to another.

It is still the object of this invention to provide an exercise device which allows a user to exercise the pectoral and abdominal muscles with little risk of injury, because no additional weights are used. Resistance is provided by the user's own body weight.

Other objects and advantages of the present invention will be recognized when the following description is considered along with the drawings.

DESCRIPTION OF THE DRAWING FIGURES

DESCRIPTION OF THE INVENTION

Figure 3:
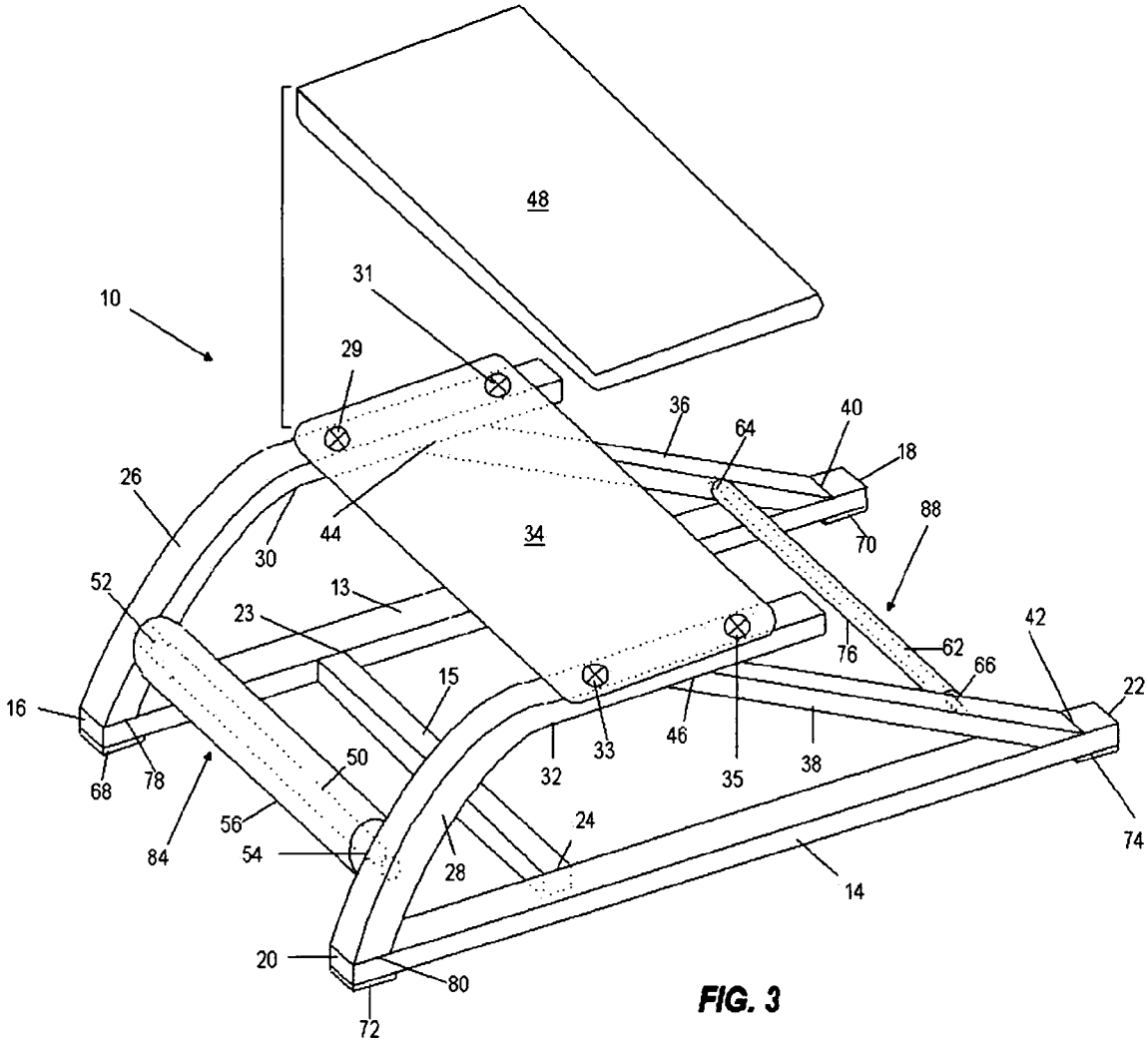
FIG. 3 is the top perspective view of the exercise equipment showing where various members of the equipment are attached to each other.
Figure 4:
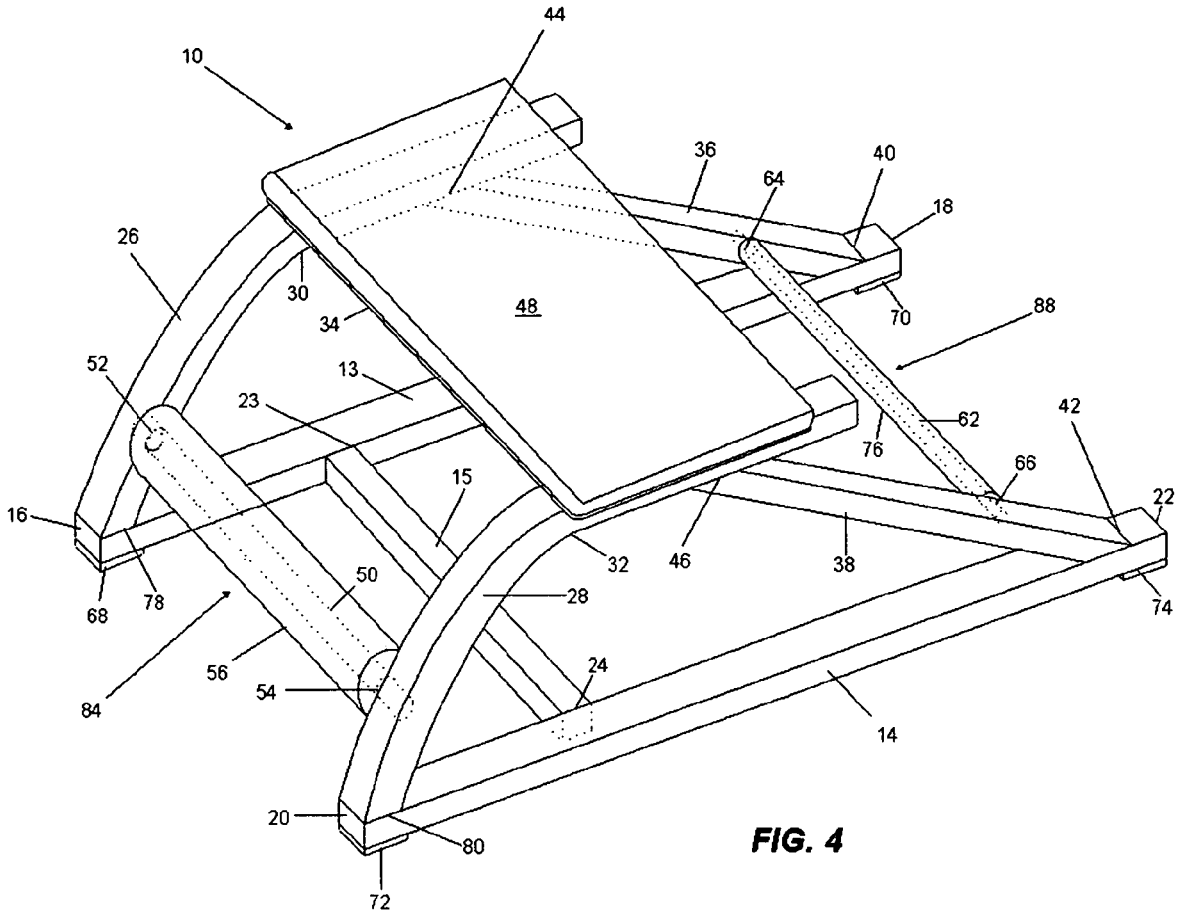
FIG. 4 is the top perspective view of the exercise equipment in accordance with the present invention.
Figure 5:
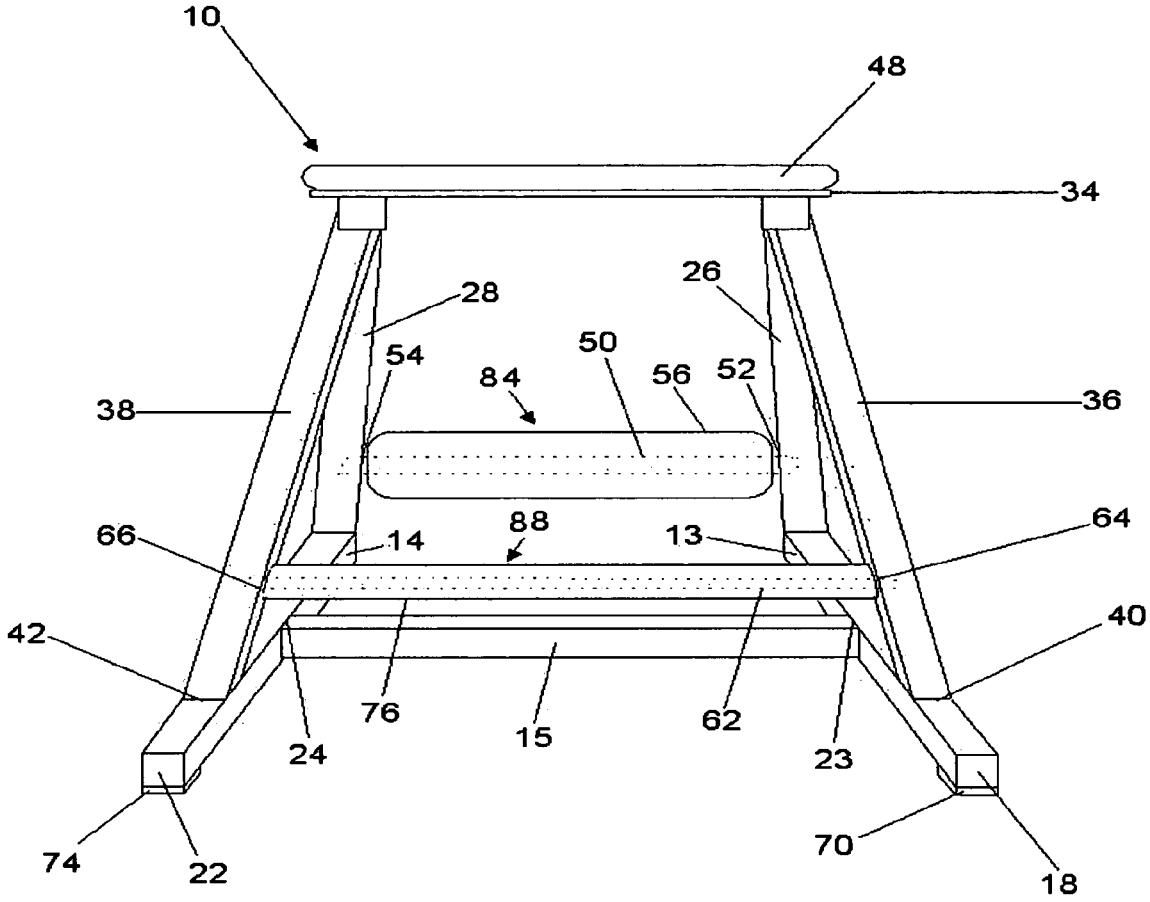
FIG. 5 is the rear view of the exercise equipment in accordance with the present invention.

Now referring to FIG. 3 and FIG. 4 in one embodiment of the present invention comprising a combination abdominal/pectoral exercise device 10, a rigid frame includes a base adapted to rest upon a floor wherein said base includes a pair of side base bars 13 and 14, of equal length and a transverse base bar 15 extending between the pair of side base bars 13 and 14. The left side base bar 13 comprises a front side 16 and a rear side 18. The right side base 14 comprises a front side 20 and a rear side 22. The left side base bar 13 and right side base bar 14 are generally parallel to each other. The transverse base bar 15 comprises an elongated bar having opposing ends generally fixed perpendicularly to the midpoint of the left side base bar at one end 23 and the midpoint of the right side base bar at the other end 24.

A generally first planar post 26 extends upwards in a curve and levels off at the peak 30 whereby the first planar post 26 is attached to the front 78 of the left base bar 13. A generally second planar post 28 extends upwards in a curve and levels off at the peak 32 whereby the second planar post 28 is attached to the front 80 of the right base bar 14.

The sitting component frame 34 is supported by a first inclined seat support bar 36 and a second inclined seat support bar 38. The first inclined seat support bar 36 is attached to the rear end 40 of the left base bar 13 whereby the first inclined seat support bar 36 is also attached to the level portion 44 of the first planar post 26. A second inclined seat support bar 38 is attached to the rear end 42 of the right base bar 14 whereby the second inclined seat support bar 38 is also attached to the level portion 46 of the second planar post 28.

One side of the rectangular sitting component frame 34 is attached to the first planar post 26 at 29 and 31. Another side of the rectangular sitting component frame 34 is attached to the second planar post 28 at 33 and 35.

A horizontally disposed seat 48 rectangular in shape is secured to the rectangular sitting component frame 34. The seat preferably includes suitable material comfortable for a user's buttocks which includes but is not limited to foam layer mounted on wood, and covered with vinyl.

A user may sit on the horizontally disposed seat 48 and depending on their size, adjust the position where their buttocks rest on the on the horizontally disposed seat in order to comfortably perform the desired exercise.

A first horizontally disposed bar 84 has opposing ends 52 and 54 whereby one end 52 is secured to the first planar post 26 and another end 54 is secured to the second planar post 28. The first horizontally disposed bar 84 includes an inner member 50 comprising rigid material and an outer member 56 comprising soft suitable material. The inner member 50 is made of material which includes but is not limited to metal, wood or other suitable material. The outer member layer 56 is made of material comfortable to a user's foot which includes but is not limited to foam material. The outer layer may be protected by other materials including but is not limited to vinyl.

Figure 1:
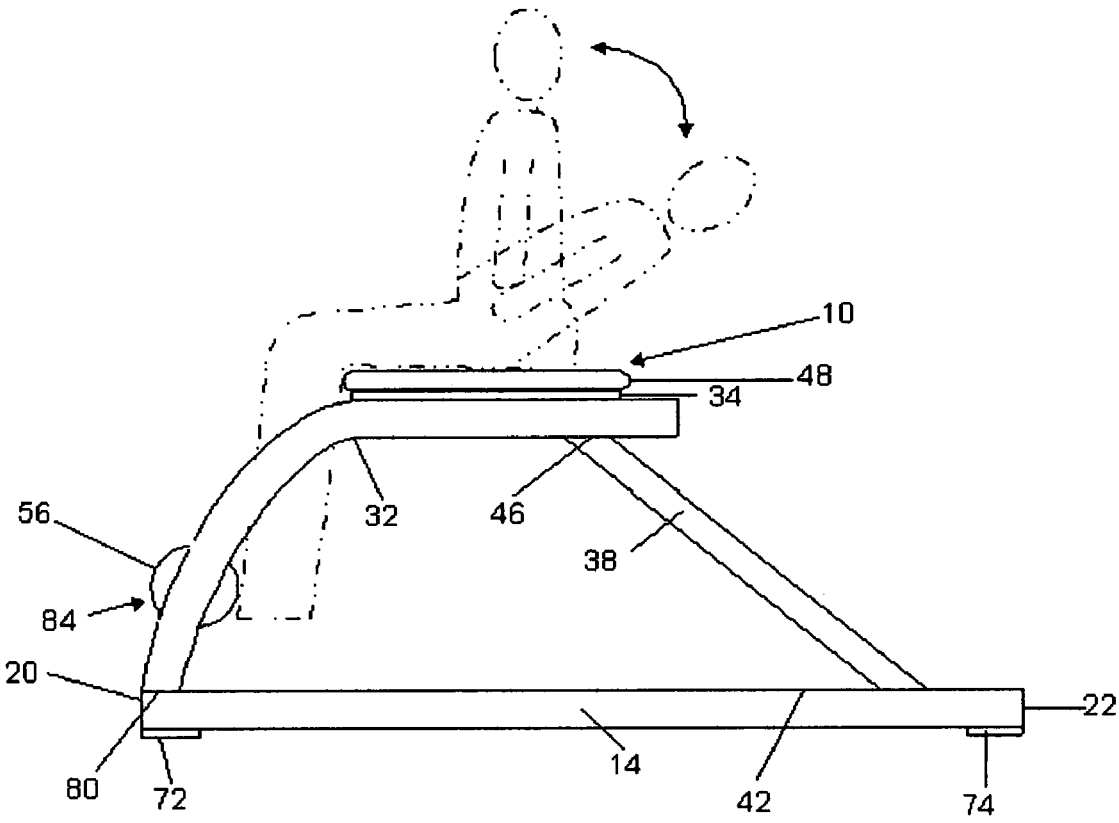
FIG. 1 is the side view of the exercise equipment being used for abdominal exercise in accordance with the present invention.

The first horizontally disposed bar 84 works as a foot restraint bar which restrains the movement of the feet during abdominal exercise. FIG. 1 illustrates a user's feet placed behind the first horizontally disposed bar during abdominal muscles exercise. The user's feet are restrained from moving forwardly beyond the first horizontally disposed bar.

A second horizontally disposed bar 88 works as a user's "push-up" bar. The second horizontally disposed bar 88 includes two opposing ends 66 and 64 whereby one end 64 is secured to the first inclined seat support bar 36 and another end 66 is secured to the second inclined seat support bar 38. The second horizontally disposed bar 88 includes an inner member 62 and an outer member 76. The inner member 62 is made of suitable material which includes but is not limited to metal. The outer member 76 is made of suitable material which includes but is not limited to rubber.

The second horizontally disposed bar 88 or "push-up" bar is attached to the first and second inclined seat support bars in manner allowing a user to firmly and comfortably grip the second horizontally disposed bar 88 with both hands. In the shown preferred embodiment, the rigid frame with a base adapted to rest upon a floor includes suitable non skid members 68, 70, 72, and 74 providing firm support once the frame rests upon a floor.

Many variations will be apparent to those skilled in the art. It is therefore to be understood, that within the scope of the appended claims, the invention may be practiced other than as specifically described.

OPERATION OF THE INVENTION

In FIG. 1, a user sitting on the seat 48 can exercise their abdominal muscles by first sitting in an upright position on the horizontally disposed seat 48, with the lower part of their feet pressing against the first horizontally disposed bar 84 above their ankles. The user then leans back from their waist at approximately 45 degrees to the horizontally disposed seat 48 then the user returns to an upright position. This exercise is repeated several times resulting in strengthening of the abdominal muscles over time.

Figure 2:
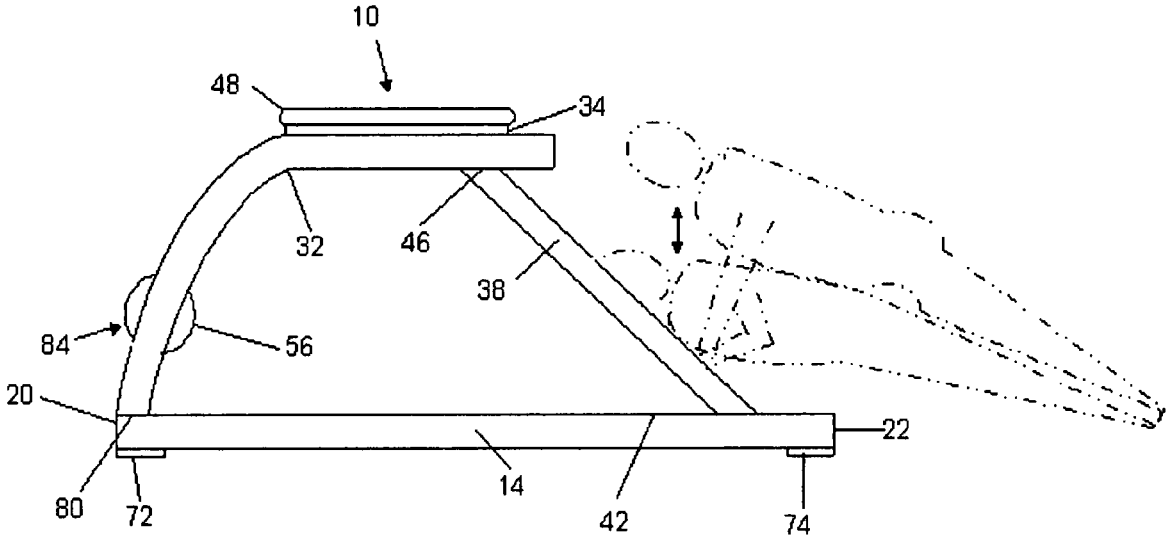
FIG. 2 is the side view of the exercise equipment being used for pectoral muscles exercise in accordance with the present invention.

Now, referring to FIG. 2 a user begins with both arms grasping the second horizontally disposed bar 88. A user then extends both arms and lowers the torso by bending the arms at the elbow to a convenient position parallel to the second horizontally disposed bar 88. The user raises the torso to the beginning or original position by extending the arms again. The repetitive exercise against resistance provided by the user's body weight strengthens the pectoral muscles of the user over time.

In another preferred embodiment, the second horizontally disposed bar is capable of being raised in height from the inclined seat support bars or lowered in height from the inclined seat support bars in order to accommodate different users. Raising or lowering the horizontally disposed bar changes the resistance against the muscles. Therefore, a user has the option of increasing or decreasing the intensity of the exercise.

In another preferred embodiment, a restraint or seat belt is provided for preventing a user from sliding off the seat during abdominal exercise. The seat belt is attached to the sitting component frame on opposite ends allowing a user to tie the seat belt generally across the user's hips.

In a further preferred embodiment, the foot restraining bar or the first horizontally disposed bar is adjustable. This embodiment would allow users to have two ways of adjustment based on the size and the length of a user. First, the user may adjust the position where their buttocks rest upon the seat. Second, the user may also move the first horizontally disposed bar upward or downward to accommodate different size and height of the user.

While preferred embodiments have been shown and described, it will be understood that it is not intended to limit the disclosure, but rather is intended to cover all modifications and alternate methods and apparatus within the spirit and scope of the invention as defined in the appended claims.

I claim:

1. An exercise device comprising:

an 'H' shaped rigid frame comprising a base to rest upon a floor surface, said base comprising a pair of side base bars of equal length and a transverse base bar extending between said side base bars, said pair of side base bars each having a left side and a right side, each left and right side base bar having a front side and a rear side, said left and right side base bars generally parallel to each other where said transverse base bar comprises an elongated bar having opposing ends generally perpendicularly fixed to the midpoint of said left side base bar at one end and at the midpoint of said right side base bar at the other end, a pair of planar posts comprising a first planar post and a second planar post wherein each said first and second planar post extends upwards in a curve, said first planar post levels off at a peak where said first planar post attaches to the front of the left side base bar and the second planar post levels off at a peak where said second planar post attaches to said front of said right base bar, a rectangular sitting component frame fixed at a first side to said first planar post at a midpoint of said first planar post and said rectangular sitting component frame fixed at said first side to said planar post to an end of said first planar post, and said rectangular sitting component frame fixed at a second side to said second planar post at a midpoint of said second planar post and fixed at said second side to said second planar post at an end of said second planar post, a horizontally disposed rectangular shaped seat secured to said rectangular sitting component frame where said seat is adjustable by moving simultaneously said rectangular sitting component frame horizontally at said first side and said second side, a pair of parallel inclined seat support bars, a first horizontally disposed bar secured to said pair of planar posts, a second horizontally disposed bar secured to said pair of parallel inclined seat support bars, a seat restraint selectively attached to said rectangular sitting component frame to prevent a user from sliding off the seat during abdominal exercises.

2. The exercise device according to claim 1 wherein said first horizontally disposed bar further including a pair of opposing ends, wherein a first horizontally disposed bar first opposing end is secured to said first planar post and said first horizontally disposed bar second opposing end is secured to said second planar post, said first horizontally disposed bar having an inner member and an outer member whereby said bar restrains movement of a user's feet during abdominal exercises by placing the feet of a user behind said bar.

3. The exercise device according to claim 1 wherein said rectangular sitting component frame includes a means for attachment to said first planar post at said peak and a means for attachment to said second planar post at said peak.

4. The exercise device of claim 1 wherein said pair of parallel inclined seat support bars comprise:

said first inclined seat support bar including a pair of opposing ends wherein a first inclined seat bar opposing end is rigidly attached to the rear of said left side base bar, and a second inclined seat bar opposing end is rigidly attached to said first planar post; and said second inclined seat support bar including a pair of opposing ends wherein one opposing end is rigidly attached to the rear of said right side base bar, and another opposing end is attached to said second planar post.

5. The exercise device of claim 4 further comprising said second horizontally disposed bar including two opposite ends wherein said second horizontally disposed bar is secured perpendicularly to said first inclined seat support bar at a first opposite incline seat end, and said second horizontally disposed bar is secured perpendicularly to the second inclined seat support bar at a second opposite incline seat end.

6. The exercise device of claim 5 wherein second horizontally disposed bar includes an inner member and an outer member for a user to comfortably grasp said second horizontally disposed bar while raising themselves upwardly and lowering themselves downwardly during exercise, said bar rigidly secured perpendicularly to said pair of inclined seat support bars.

7. The exercise device of claim 1 wherein said base adapted to rest upon a floor includes a plurality of suitable non skid members attached to said base frame.

8. The exercise device of claim 1 wherein said seat restraint is attached to said sitting component frame at opposing sides of said sitting component frame and wherein said seat restraint comprises a seat belt selectively attached to said sitting component frame on opposing ends of said sitting component frame.

* * * * *